US011371764B2

(12) United States Patent
Jia et al.

(10) Patent No.: US 11,371,764 B2
(45) Date of Patent: Jun. 28, 2022

(54) AIR CONDITIONING SYSTEM AND CONTROL METHOD THEREOF

(71) Applicants: Gree Electric Appliances (Wuhan) Co., Ltd, Hubei (CN); Gree Electric Appliances, Inc. of Zhuhai, Guangdong (CN)

(72) Inventors: Xiang Jia, Guangdong (CN); Shiqiang Zhang, Guangdong (CN); Peixing Yang, Guangdong (CN); Mingxiang Zhang, Guangdong (CN)

(73) Assignees: Gree Electric Appliances (Wuhan) Co., Ltd, Wuhan (CN); Gree Electric Appliances, Inc. of Zhuhai, Zhuhai (CN)

( * ) Notice: Subject to any disclaimer, the term of this patent is extended or adjusted under 35 U.S.C. 154(b) by 100 days.

(21) Appl. No.: 16/640,652

(22) PCT Filed: Aug. 21, 2018

(86) PCT No.: PCT/CN2018/101580
§ 371 (c)(1),
(2) Date: Feb. 20, 2020

(87) PCT Pub. No.: WO2019/037722
PCT Pub. Date: Feb. 28, 2019

(65) Prior Publication Data

US 2020/0355416 A1 Nov. 12, 2020

(30) Foreign Application Priority Data

Aug. 22, 2017 (CN) ..... 201710729358.1

(51) Int. Cl.
*F25B 43/00* (2006.01)
*F25B 13/00* (2006.01)
(Continued)

(52) U.S. Cl.
CPC ..... *F25B 49/02* (2013.01); *F25B 13/00* (2013.01); *F25B 41/24* (2021.01); *F25B 43/003* (2013.01);
(Continued)

(58) Field of Classification Search
CPC ..... F25B 43/006; F25B 41/20; F25B 41/31; F25B 41/37; F25B 39/00; F25B 2331/005;
(Continued)

(56) References Cited

U.S. PATENT DOCUMENTS 4,862,702 A * 9/1989 O'Neal ..... F25B 49/027 62/196.4
5,752,390 A * 5/1998 Hyde ..... F25B 41/00 62/196.4
(Continued)

FOREIGN PATENT DOCUMENTS

CN 103851841 A 6/2014
CN 104197432 A 12/2014
(Continued)

OTHER PUBLICATIONS

International Search Report, dated Oct. 22, 2018, in International application No. PCT/CN2018/101580, filed on Aug. 21, 2018.
(Continued)

*Primary Examiner* — Kun Kai Ma
(74) *Attorney, Agent, or Firm* — McAndrews, Held & Malloy, Ltd.

(57) ABSTRACT

An air conditioning system and a control method are provided. The air conditioning system includes: at least one heat exchanger (1, 2); and at least one control mechanism. Each control mechanism is connected to one of the at least one heat exchanger (1, 2) and is configured to control the corresponding heat exchanger to switch between a first
(Continued)

working state and a second working state. The heat exchanger (1, 2) drains liquid when in the first working state and stores liquid when in the second working state.

8 Claims, 4 Drawing Sheets

(51) Int. Cl.

| | |
|---|---|
| ***F25B 41/20*** | (2021.01) |
| ***F25B 41/31*** | (2021.01) |
| ***F25B 41/37*** | (2021.01) |
| ***F25B 39/00*** | (2006.01) |
| ***F25B 49/02*** | (2006.01) |
| ***F25B 41/24*** | (2021.01) |

(52) U.S. Cl.
CPC ..... *F25B 43/006* (2013.01); *F25B 39/00* (2013.01); *F25B 2313/005* (2013.01); *F25B 2600/2513* (2013.01); *F25B 2600/2515* (2013.01); *F25B 2700/04* (2013.01); *F25B 2700/2106* (2013.01)

(58) Field of Classification Search
CPC ..... F25B 2600/2531; F25B 2600/2515; F25B 2700/04; F25B 2313/0233; F25B 49/02; F25B 2500/11; F25B 2600/11; F25B 2600/25; F25B 2600/2511; F25B 2500/23; F24F 11/84
See application file for complete search history.

(56) References Cited

U.S. PATENT DOCUMENTS

| | | | | |
|---|---|---|---|---|
| 2010/0257894 | A1* | 10/2010 | Fujimoto | F25B 13/00 62/510 |
| 2011/0000240 | A1* | 1/2011 | Yamada | F25B 49/005 62/208 |
| 2014/0165628 | A1* | 6/2014 | Tamura | F25B 47/022 62/80 |
| 2015/0020535 | A1* | 1/2015 | Hatomura | F25B 13/00 62/160 |
| 2016/0273795 | A1* | 9/2016 | Takenaka | F25B 47/022 |
| 2017/0284695 | A1* | 10/2017 | Dai | F24F 11/00 |
| 2018/0292096 | A1* | 10/2018 | Onaka | F25B 41/00 |
| 2019/0063793 | A1* | 2/2019 | Tang | F25B 47/025 |
| 2019/0249912 | A1* | 8/2019 | Yamada | F25B 13/00 |
| 2019/0277550 | A1* | 9/2019 | Yokozeki | F25B 49/02 |
| 2020/0200406 | A1* | 6/2020 | Koda | F24F 1/36 |
| 2020/0232673 | A1* | 7/2020 | Kozasa | F25B 30/02 |
| 2020/0370808 | A1* | 11/2020 | Feng | F25B 41/40 |

FOREIGN PATENT DOCUMENTS

| | | | |
|---|---|---|---|
| CN | 104520656 | A | 4/2015 |
| CN | 104654679 | A | 5/2015 |
| CN | 104807229 | A | 7/2015 |
| CN | 205137728 | U | 4/2016 |
| CN | 105987456 | A | 10/2016 |
| CN | 106382701 | A | 2/2017 |
| CN | 106403348 | A | 2/2017 |
| CN | 107560117 | A | 1/2018 |
| EP | 2921326 | A2 | 9/2015 |
| JP | H062969 | A | 1/1994 |
| JP | 2001108317 | A | 4/2001 |
| KR | 20080074691 | A | 8/2008 |

OTHER PUBLICATIONS

Chinese search report 1 dated Aug. 22, 2017 in Chinese application No. 2017107293581 (1 page).
Chinese search report 2 dated Aug. 22, 2017 in Chinese application No. 2017107293581 (1 page).
The extended European search report for Application No. 18849362.1, dated Apr. 21, 2021, European Patent Office, Germany (8 pages).

* cited by examiner

AIR CONDITIONING SYSTEM AND CONTROL METHOD THEREOF

This application is a 371 of International Patent Application No. PCT/CN2018/101580, filed Aug. 21, 2018, which claims benefit of Chinese Patent Application No. 201710729358.1, filed to the China Patent Office on Aug. 22, 2017, entitled "Air Conditioning System and Control Method Therefor," contents of both of which are hereby incorporated by reference in their entirety.

TECHNICAL FIELD

Embodiments of the disclosure relate to the field of air conditioning control, in particular to an air conditioning system and a control method thereof.

BACKGROUND

One characteristic of a multi-split air-conditioning system is that: a single outdoor unit may be connected to multiple indoor units, thereby facilitating installation and saving installation space. But for a multi-split system, when a unit operates under low load, or the number of indoor units turned on is small, there are often some problems of low load control reliability because the volume ratio of outdoor heat exchanger to indoor heat exchanger is too large, or there is much circulating refrigerant of the system. For example, in an actual use process, for transition seasons or some special application places, refrigerating operation is often under partial load, at this point, a condensing pressure is comparatively low, and most refrigerant often accumulates in a condenser or a liquid accumulator. The low condensing pressure will cause a too small difference between a pressure in front of a valve and a pressure behind the valve, and cause an insufficient liquid feeding power, which decreases the adjusting ability of throttle mechanisms like an Electronic Expansion Valve (EEV), decreases the refrigerating capacity, and easily causes system backflow. The low condensing pressure will also cause relatively low discharge superheat degree, and enhance the ability of carrying lubricating oil of the refrigerant, which affects reliable operation of a compressor.

Aiming at the technical problem in the related art that the operating reliability is relatively low in the case of too much refrigerant, no effective solution has been proposed.

SUMMARY

According to an aspect of the embodiments of the disclosure, an air conditioning system is provided. The air conditioning system includes: at least one heat exchanger; and at least one control mechanism. Each control mechanism is connected to one of the at least one heat exchanger and is configured to control the corresponding heat exchanger to switch between a first working state and a second working state. The heat exchanger drains liquid when in the first working state and stores liquid when in the second working state.

According to another aspect of the embodiments of the disclosure, a control method of an air conditioning system is also provided. The method includes that: at least one load parameter of the air conditioning system is determined; and a control instruction is sent to the control mechanism in the air conditioning system according to at least one load parameter of the air conditioning system. The control instruction is used for instructing the control mechanism to control the corresponding heat exchanger to switch between the first working state and the second working state. The heat exchanger drains liquid when in the first working state and stores liquid when in the second working state.

BRIEF DESCRIPTION OF THE DRAWINGS

The accompanying drawings described here are used for providing further understanding of the disclosure, and constitute a part of the application. Schematic embodiments of the disclosure and description thereof are used for illustrating the disclosure and not intended to form an improper limit to the disclosure. In the accompanying drawings.

DETAILED DESCRIPTION OF THE EMBODIMENTS

Figure 1:
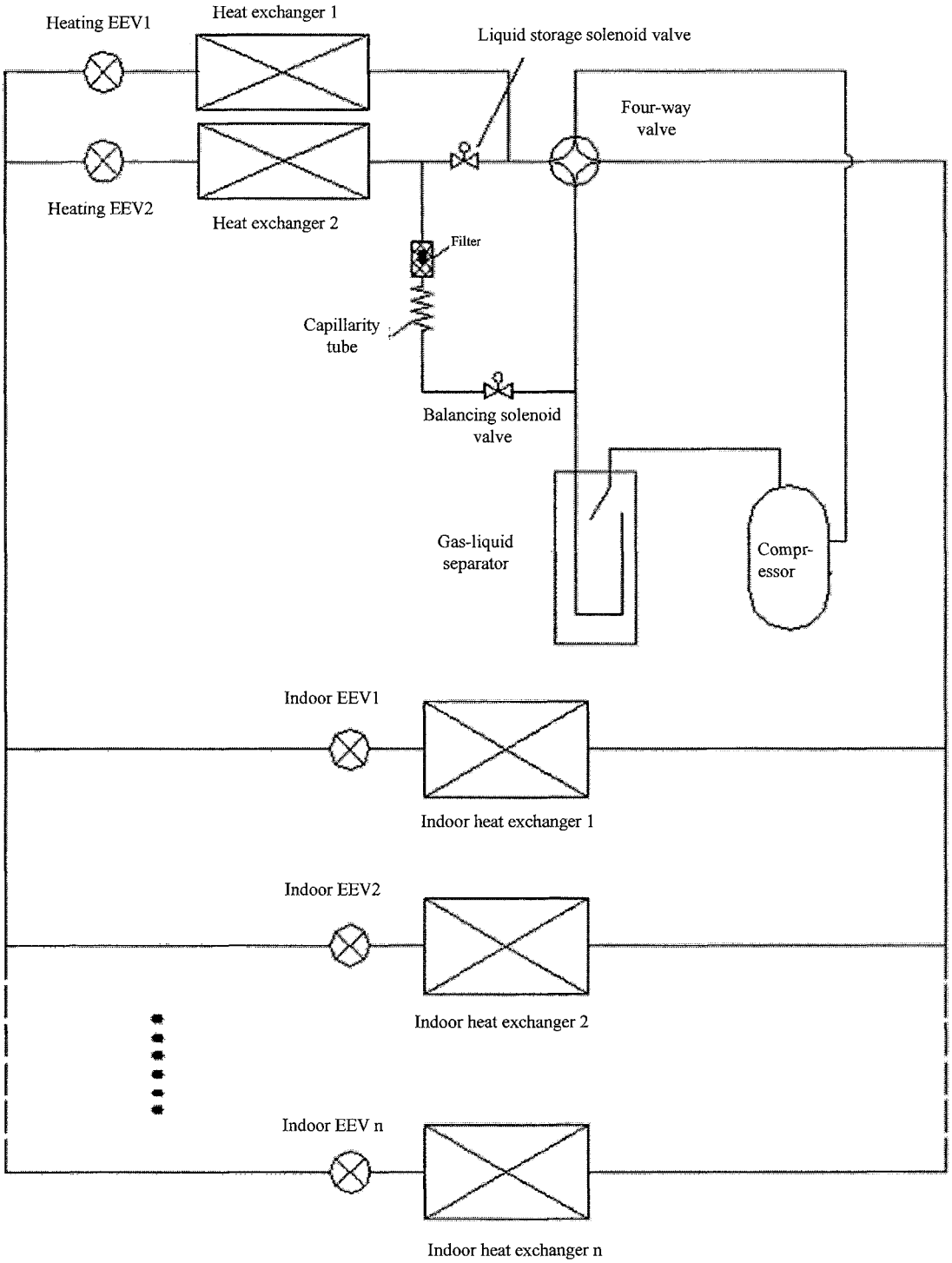
FIG. 1 is a schematic diagram of an optional air conditioning system according to embodiments of the disclosure.

In order to make those skilled in the art understand the solutions of the disclosure better, the technical solutions in the embodiments of the disclosure are clearly and completely elaborated below in combination with the accompanying drawings. It is apparent that the described embodiments are only a part of the embodiments of the disclosure but not all. Based on the embodiments of the disclosure, all the other embodiments obtained by those of ordinary skill in the art on the premise of not contributing creative effort should belong to the protection scope of the disclosure.

It is to be noted that the terms like "first" and "second" in the specification, claims and accompanying drawings of the disclosure are used for differentiating the similar objects, but do not have to describe a specific order or a sequence. It should be understood that the objects may be exchanged under appropriate circumstances, so that the embodiments of the disclosure described here may be implemented in an order different from that described or shown here. In addition, terms "include" and "have" and any variations thereof are intended to cover non-exclusive inclusions. For example, it is not limited for processes, methods, systems, products or devices containing a series of steps or units to clearly list those steps or units, and other steps which are not clearly listed or are inherent to these processes, methods, products or devices may be included instead.

The application provides embodiments of an air conditioning system.

The air conditioning system includes at least one heat exchanger and at least one control mechanism. Each control mechanism is connected to one of the at least one heat exchanger and is configured to control the corresponding heat exchanger to switch between a first working state and a second working state. The heat exchanger drains liquid when in the first working state and stores liquid when in the second working state.

In some embodiments, the control mechanism includes one or more switching valves which are configured to control whether the corresponding heat exchanger disconnects from a circulation loop of refrigerant, that is, control whether the corresponding heat exchanger participates in a circulation process of the refrigerant.

In some embodiments, the switching valve in the control mechanism is an electronic valve. Each electronic valve is controlled through a controller in the air conditioning system, so as to control the corresponding heat exchanger to switch between the first working state and the second working state. Specifically, the air conditioning system further includes: the controller, which is connected to the control mechanism in the air conditioning system and is configured to send a control instruction to the control mechanism in the air conditioning system according to at least one load parameter of the air conditioning system. The control instruction is used for instructing the control mechanism to control the corresponding heat exchanger to be in the first working state or the second working state.

In the air conditioning system provided by the some embodiments of the disclosure, the heat exchanger is regarded as a refrigerant regulator, which controls and regulates the amount of circulating refrigerant in the air conditioning system according to an operating parameter state of the system. When at least one load parameter of the air conditioning system decreases, the heat exchanger is taken as a liquid accumulator to drain liquid, so as to reduce the amount of circulating refrigerant; and when at least one load parameter of the air conditioning system increases, the heat exchanger is controlled to drain liquid, so as to increase the amount of circulating refrigerant. In this way, operating comfort and reliability of units of the air conditioning system is improved.

Taking the air conditioning system shown in FIG. 1 for example, the air conditioning system further includes a four-way valve and a compressor. Each control mechanism is arranged between the heat exchanger correspondingly controlled by it and the four-way valve. Specifically, as shown in FIG. 1, at least one heat exchanger in the air conditioning system includes heat exchanger 1 and heat exchanger 2. It is to be noted that the heat exchanger 1 and the heat exchanger 2 are outdoor heat exchangers. The heat exchanger 2 (the first heat exchanger) is connected to the control mechanism (the first control mechanism), and the control mechanism includes a liquid storage solenoid valve (the first solenoid valve) and a balancing solenoid valve (the second solenoid valve). The liquid storage solenoid valve is arranged between the heat exchanger 2 and the four-way valve, and the balancing solenoid valve is arranged between the heat exchanger 2 and the compressor. When the liquid storage solenoid valve opens and the balancing solenoid valve closes, the heat exchanger 2 is in the first working state; and when the liquid storage solenoid valve closes and the balancing solenoid valve opens, the heat exchanger 2 is in the second working state.

In some embodiments, the first control mechanism further includes: a throttle mechanism, which is arranged between the first heat exchanger and the second solenoid valve. As shown in FIG. 1, the throttle mechanism includes: a filter and a capillarity tube. The filter is connected to the heat exchanger 2. The capillarity tube is arranged between the filter and the balancing solenoid valve.

As shown in FIG. 1, as an optional implementation mode of the above embodiments, the air conditioning system further includes a gas-liquid separator. The gas-liquid separator is arranged between the four-way valve and the compressor.

In the embodiments of the air conditioning system shown in FIG. 1, the heat exchanger 1 and the heat exchanger 2 are an outdoor heat exchanger group. The air conditioning system further includes an indoor heat exchanger group, which is connected to the outdoor heat exchanger group. Each outdoor heat exchanger is provided with an expansion valve. The expansion valve is configured to control the disconnection of a flow path between the corresponding heat exchanger and the indoor heat exchanger group when the amount of refrigerant stored by the corresponding heat exchanger exceeds a preset threshold. As shown in FIG. 1, the indoor heat exchanger group includes indoor heat exchanger 1, indoor heat exchanger 2 and indoor heat exchanger 3. The heat exchanger 2 is provided with a heating EEV2. In some embodiment, when the amount of refrigerant in the heat exchanger 2 exceeds the preset threshold, the heating EEV2 is closed to control the refrigerant to no longer enter the heat exchanger 2. In some embodiments, it is to be noted that when the heat exchanger 2 does not participate in the circulation process of the refrigerant, the heat exchanger 2 also needs to be connected to the indoor heat exchanger group to recycle the refrigerant, and after recycling the refrigerant is finished, a flow path between the heater exchanger 2 and the indoor heat exchanger group is disconnected.

In some embodiments, each heat exchanger in the air conditioning system is provided with an EEV. As shown in FIG. 1, the heating EEV1 is connected to the heat exchanger 1, the heating EEV2 is connected to the heat exchanger 2, an indoor EEV1 is connected to an indoor heat exchanger 1, an indoor EEV2 is connected to an indoor heat exchanger 2, and an indoor EEV3 is connected to an indoor heat exchanger 3.

Figure 2:
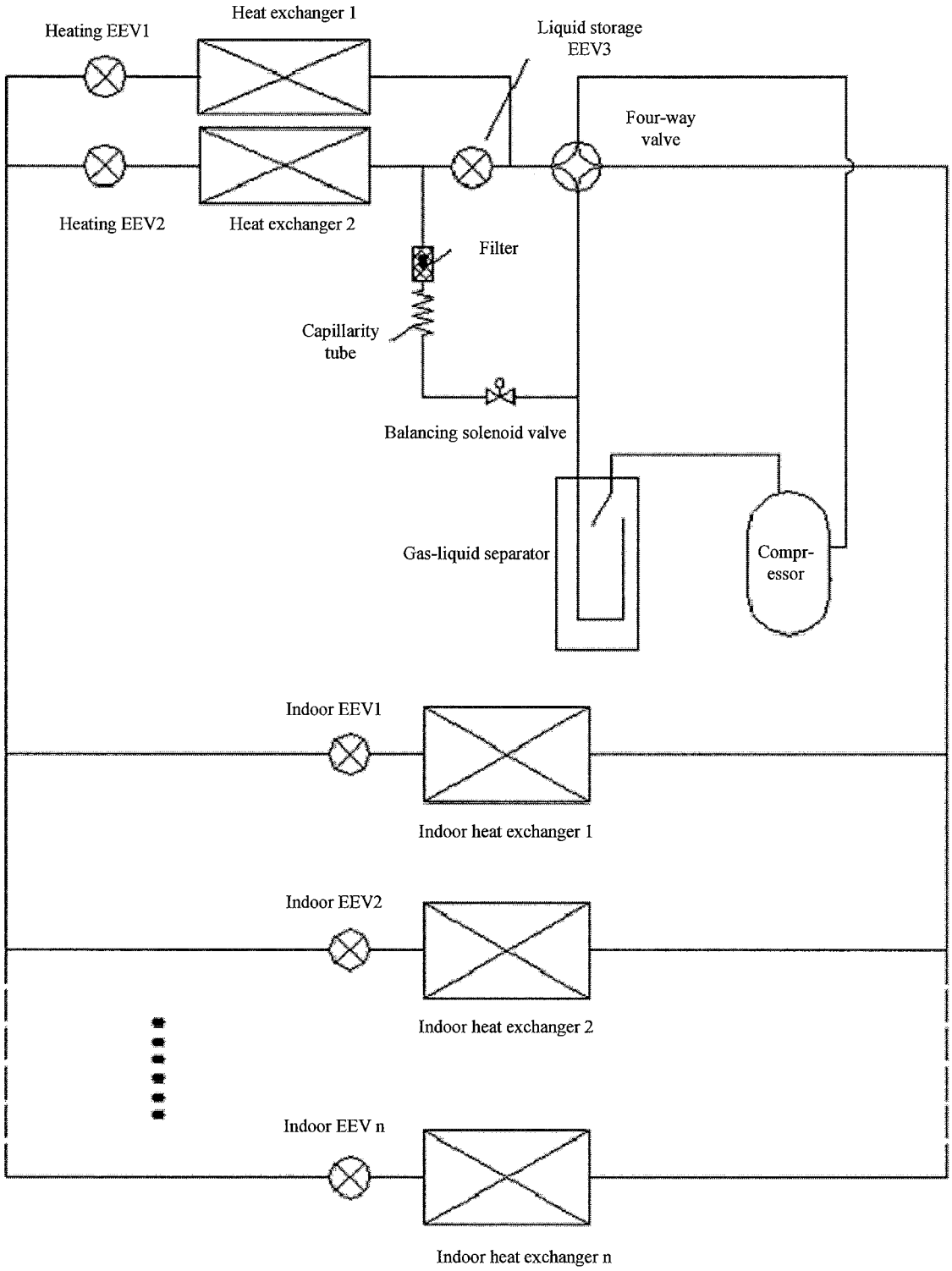
FIG. 2 is a schematic diagram of another optional air conditioning system according to embodiments of the disclosure.

FIG. 2 is another optional embodiment of the embodiment shown in FIG. 1. The difference between the embodiment shown in FIG. 2 and the embodiment shown in FIG. 1 is that the liquid storage solenoid valve is replaced with a liquid storage EEV3. In some embodiments, using the EEV may control accurately a liquid storage heat exchanger to drain liquid during heating.

Figure 3:
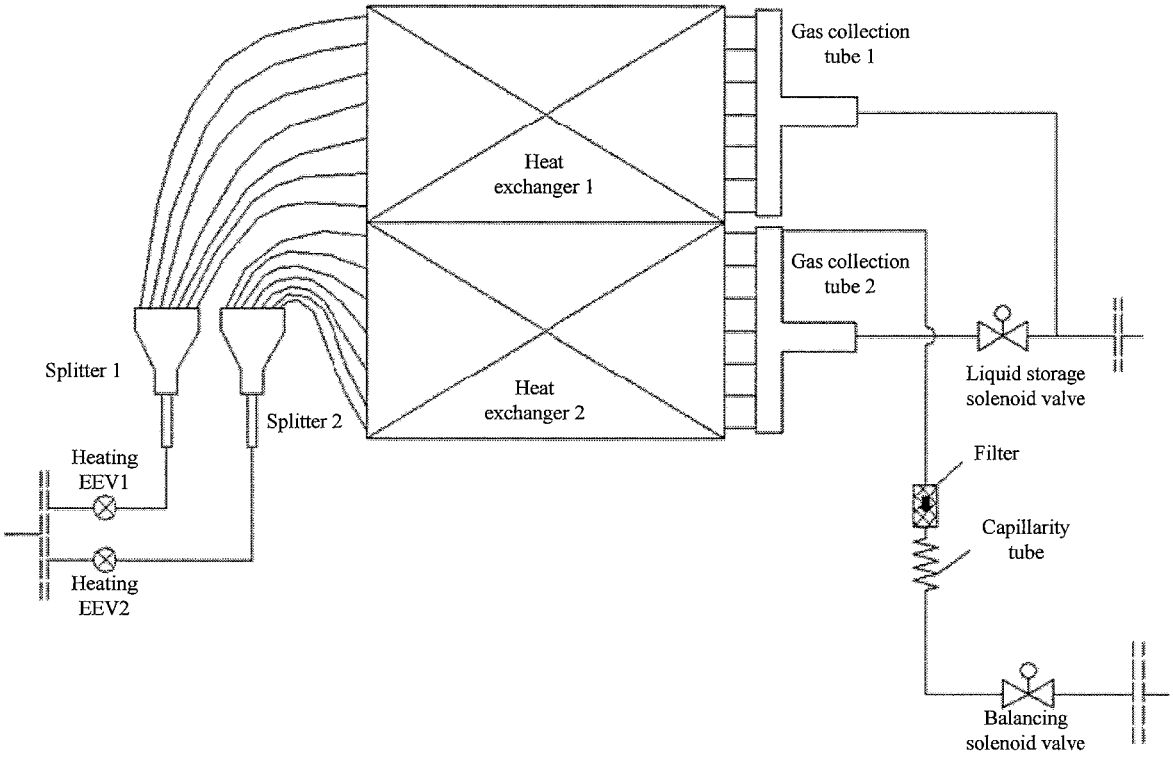
FIG. 3 is a schematic diagram of another optional air conditioning system according to embodiments of the disclosure.

As another optional implementation mode of the above embodiments, there is a splitter arranged between each heat exchanger and the EEV, and each heat exchanger is also provided with a gas collection tube. As shown in FIG. 3, the embodiment shown in FIG. 3 is an enlarged diagram of the corresponding part in the embodiment shown in FIG. 1, the first control mechanism further includes a throttle mechanism. The throttle mechanism is connected to the top of the gas collection tube 2.

The working principle of the above embodiments is elaborated below.

When the air conditioning system operates in a cooling mode:

when the air conditioning system operates with high load parameters, a (condensing) heat exchanger volume required by the air conditioning system is relatively large; at this point, the liquid storage solenoid valve is controlled to open, the balancing solenoid valve is controlled to close, the heating EEV1 and the heating EEV2 are controlled to open, and both the heat exchanger 1 and the heat exchanger 2 are used as a condenser. When the air conditioning system operates at a low frequency and with low load parameters, the condensing heat exchanger volume required by the air conditioning system is relatively small, and the required amount of circulating refrigerant is relatively small; at this point, the liquid storage solenoid valve is controlled to close, the heating EEV1 is controlled to open, and the heat exchanger 1 is used as the condenser; and at this point, the heat exchanger 2 is not set for condensation heat transfer and is used as a liquid storage device, the heating EEV2 is controlled to open, the balancing solenoid valve is controlled to open, a part of refrigerant enters the heat exchanger 2 through the heating EEV2, and the heat exchanger 2 is configured to store more system refrigerant. When liquid storage is finished, the heating EEV2 closes, and the balancing solenoid valve closes; and when the system resumes operating with the high load parameters, the liquid storage solenoid valve is controlled to open, and the heating EEV2 is controlled to open.

Similarly, when only the indoor units of the air conditioning system are turned on or the number of the turned-on indoor units is relatively small, at least one load parameter of the air conditioning system is relatively low, a heat exchange volume ratio between an outdoor condenser (the outdoor heat exchanger) and an indoor evaporator (the indoor heat exchanger) is relatively large, the amount of circulating refrigerant required by the air conditioning system is relatively small; at this point, the heat exchanger 2 is not set as the condenser, or is used as the liquid storage device, thereby optimizing an evaporating pressure of the air conditioning system, and improving the control reliability of the air conditioning system.

When the air conditioning system operates in a heating mode:

when the air conditioning system operates with the high load parameters, an evaporating heat exchanger volume required by the air conditioning system is relatively large; at this point, the liquid storage solenoid valve is controlled to open, the balancing solenoid valve is controlled to close, the heating EEV1 and the heating EEV2 are controlled to open, and both the heat exchanger 1 and the heat exchanger 2 are used as the evaporator. When the air conditioning system operates at the low frequency and with the low load parameters, the evaporating heat exchanger volume required by the air conditioning system is relatively small, and the required amount of circulating refrigerant is relatively small; at this point, the liquid storage solenoid valve is controlled to close, the heating EEV1 is controlled to open, and the heat exchanger 1 is used as the evaporator; and at this point, the heat exchanger 2 is not set for evaporation heat transfer and is used as the liquid storage device, the heating EEV2 is controlled to open, the balancing solenoid valve is controlled to open, a part of refrigerant enters the heat exchanger 2 through the heating EEV2, and the heat exchanger 2 is configured to store more system refrigerant. When the liquid storage is finished, the heating EEV2 closes, and the balancing solenoid valve closes; and when the air conditioning system resumes operating with the high load parameters, the liquid storage solenoid valve is controlled to open, and the heating EEV2 is controlled to open. Optionally, at least one load parameter includes at least one of the following parameters: an actual unit operating capacity ratio of the air conditioning system; an ambient temperature of an outdoor unit of the air conditioning system; a high pressure parameter of the air conditioning system; a low pressure parameter of the air conditioning system; a discharge superheat degree of the air conditioning system; and a supercooling degree of an indoor unit of the air conditioning system. The specific control method adopts the embodiments of the control method of the air conditioning system provided by the embodiments of the disclosure, and will not be repeated here.

Similarly, when only the indoor units of the air conditioning system are turned on or the number of the turned-on indoor units is relatively small, the heat exchange volume ratio between an outdoor evaporator and an indoor condenser is relatively large, the amount of circulating refrigerant required by the air conditioning system is relatively small; at this point, the heat exchanger 2 is not set as the evaporator, and is used as the liquid storage device, thereby optimizing an condensing pressure of the air conditioning system, and improving the control reliability of the air conditioning system.

In some embodiments, it is to be noted that the above air conditioning system is a multi-split air-conditioning system, including multiple indoor units and one or more outdoor units.

The application also provides embodiments of a control method of an air conditioning system.

Figure 4:
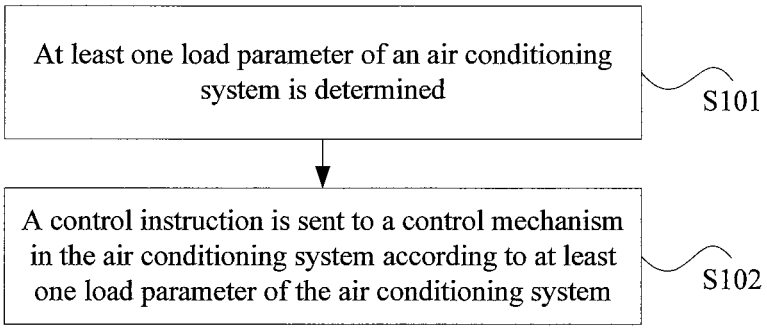
FIG. 4 is a flowchart of a control method of an optional air conditioning system according to embodiments of the disclosure.

FIG. 4 is a flowchart of a control method of an optional air conditioning system according to embodiments of the disclosure. As shown in FIG. 4, the method includes the following steps.

At S101, at least one load parameter of the air conditioning system is determined.

At S102, a control instruction is sent to the control mechanism in the air conditioning system according to at least one load parameter of the air conditioning system. The control instruction is used for instructing the control mechanism to control the corresponding heat exchanger to switch between the first working state and the second working state. The heat exchanger drains liquid when in the first working state and stores liquid when in the second working state.

By determining at least one load parameter of the air conditioning system, and sending the control instruction to the control mechanism in the air conditioning system according to at least one load parameter of the air conditioning system, so as to instruct the control mechanism to control the corresponding heat exchanger to switch between as the heat exchanger and as the liquid accumulator, the embodiments solve the technical problem in the prior art that the operating reliability is relatively low in the case of too much refrigerant, and achieves technical effects that when fewer load parameters of the air conditioning system are available, the refrigerant is stored by a part of heat exchangers to reduce the amount of circulating refrigerant, thereby improving the operating reliability of the air conditioning system.

In some embodiments, the heat exchanger in the air conditioning system includes the indoor heat exchanger group and the outdoor heat exchanger group. The outdoor heat exchanger group includes the first heat exchanger. The expansion valve is arranged between the first heat exchanger and the indoor heat exchanger group. The operation that the control instruction is sent to the control mechanism in the air conditioning system according to at least one load parameter of the air conditioning system includes that: it is judged whether the amount of refrigerant in the first heat exchanger exceeds the preset threshold; and if the result is judged as yes, the expansion valve is controlled to close.

In some embodiments, at least one load parameter includes at least one of the following parameters: the actual unit operating capacity ratio of the air conditioning system; the ambient temperature of the outdoor unit of the air conditioning system; the high pressure parameter of the air conditioning system; the low pressure parameter of the air conditioning system; the discharge superheat degree of the air conditioning system; and the supercooling degree of the indoor unit of the air conditioning system.

For example, it is possible to judge, by detecting the ambient temperature of the outdoor unit and the actual unit operating capacity ratio, whether the outdoor heat exchanger 2 is used for heat exchange as the heat exchanger or used for regulating the amount of refrigerant of the system as the liquid accumulator. When a cooling ambient temperature of the unit is relatively low (the ambient temperature is lower than A□), or a heating ambient temperature is relatively high (the ambient temperature is higher than A□), and the actual unit operating capacity ratio of the unit is relatively low (the actual unit operating capacity ratio is less than C %), the heat exchanger 2 is controlled as the liquid accumulator to drain liquid or perform drain control.

For other examples, whether the refrigerant of the system is too much or too less is judged by detecting the high pressure, the low pressure, the discharge superheat degree (discharge temperature-high pressure), the supercooling degree (high pressure-temperature after condensing), and so on, and it is judged whether the heat exchanger drains liquid or stores liquid in combination with a heating state or a cooling state of the air conditioning system. Specifically, when the air conditioning system operates in the cooling mode, if it is determined that there is too much refrigerant, the liquid storage solenoid valve closes, the heating EEV2 opens, the balancing solenoid valve opens, the heat exchanger is controlled to drain liquid, and at least some valves close when the liquid storage is finished; if it is determined that there is too less refrigerant, the liquid storage solenoid valve opens, the heating EEV2 opens, the balancing solenoid valve keeps closing, and liquid storage control is performed; and when liquid drainage is finished, the liquid storage solenoid valve and the balancing solenoid valve close first, and the heating EEV2 closes after X seconds. When the air conditioning system operates in the heating mode, if it is determined that there is too much refrigerant, the liquid storage solenoid valve closes, the heating EEV2 opens, the balancing solenoid valve opens, liquid drainage control is performed, and at least some the valves close when the liquid storage is finished; if it is determined that there is too less refrigerant, the liquid storage solenoid valve opens, the heating EEV2 closes, the balancing solenoid valve keeps closing, the liquid storage control is performed, and when liquid drainage is finished, all the valves close.

It is to be noted that although the flowchart in the accompanying drawings shows a logical sequence, in some cases, the shown or described steps is executed in a sequence different from the sequence here.

The disclosure provides a control method of an air conditioning system, for optimizing system performance and operational reliability of the multi-split air-conditioning system when operating with the low load parameters. The disclosure at least can solve the following technical problems.

① through the optimal control of a multi-split outdoor heat exchanger, the embodiments of the disclosure reduce system backflow when the unit operates with the low load parameters, increase the discharge superheat degree, and improve the energy efficiency of the units when multi-split units operate with the low load parameters;

② through the optimal control of the multi-split outdoor heat exchanger, the embodiments of the disclosure optimize the control of the amount of circulating refrigerant when the multi-split units operate with the low load parameters, and by using a part of the heat exchangers as the liquid storage device, the liquid accumulator in the multi-split system is cancelled or the volume of the liquid accumulator is reduced, thereby the perfusion amount of the refrigerant in the air conditioning system is reduced, backflow reducing, and improving the operational reliability of the unit;

③ through the optimal control of the multi-split outdoor heat exchanger, the embodiments of the disclosure regulate a volume ratio between the condenser and the evaporator of the system, optimize the condensing pressure and the evaporating pressure, and improve the operational performance and reliability of the system when only the indoor unit of the multi-split units is turned on or the number of the indoor units turned on is small; and ④ through the optimal control of the multi-split outdoor heat exchanger, the disclosure replaces the refrigerant regulator with the heat exchanger, optimizes the regulation of the amount of circulating refrigerant in the system, and improve operating comfort and reliability of the units.

The disclosure at least can achieve the following beneficial effects.

Through the optimal control of the multi-split outdoor heat exchanger, the energy efficiency of the whole machine when the multi-split units operate with the low load parameters and the number of the turned-on units is relatively small is improved, and the reliability of system control is improved, which is beneficial to the long-term and reliable operation of the multi-split system.

The sequence of the embodiments of the application does not represent the merits of the embodiments.

The above embodiments of the application are only schematic. In the above embodiments of the application, the descriptions of the embodiments focus on different aspects. A part which is not described in certain embodiments in detail may refer to the related description of the other embodiments. In the several embodiments provided in the application, it should be understood that the technical contents disclosed may be realized in other ways.

The above is only the preferred embodiments of the application; it should be indicated that, on the premise of not departing from the principles of the application, those of ordinary skill in the art may also make a number of improvements and supplements, and these improvements and supplements should fall within the protection scope of the application.

INDUSTRIAL APPLICABILITY

The solutions provided by the embodiments of the disclosure may be applied to the control process of an air conditioner. There is at least one heat exchanger and at least one control mechanism; each control mechanism is connected to one of the at least one heat exchange and is configured to control the corresponding heat exchanger to switch between the first working state and the second working state; and the heat exchanger drains liquid when in the first working state and stores liquid when in the second working state; in such a manner, the technical problem in the prior art that the operating reliability is relatively low in the case of too much refrigerant is solved, and the technical effects that when fewer load parameters of the air conditioning system are available, the refrigerant is stored by a part of heat exchangers to reduce the amount of circulating refrigerant, thereby improving the operating reliability of the air conditioning system are achieved.

What is claimed is:

1. An air conditioning system, comprising:

at least one heat exchanger; and at least one control mechanism; each of the at least one control mechanism is connected to one of the at least one heat exchanger and is configured to control the corresponding one of the at least one heat exchanger to switch between a first working state and a second working state;

wherein the at least one heat exchanger drains liquid when in the first working state and stores liquid when in the second working state;

a four-way valve and a compressor; wherein, each of the at least one control mechanism is arranged between the at least one heat exchanger correspondingly controlled by the at least one heat exchanger and the four-way valve;

wherein at least one control mechanism comprises a first control mechanism which correspondingly controls a first heat exchanger of the at least one heat exchanger; wherein the first control mechanism comprises: a first solenoid valve, which is arranged between the first heat exchanger and the four-way valve; and a second solenoid valve, which is arranged between the first heat exchanger and the compressor, wherein, in a case that the first solenoid valve opens and the second solenoid valve closes, the first heat exchanger is in the first working state, and when the first solenoid valve closes and the second solenoid valve opens, the first heat exchanger is in the second working state; a throttle mechanism, which is arranged between the first heat exchanger and the second solenoid valve;

wherein the throttle mechanism comprises: a filter, which is connected to the first heat exchanger; and a capillarity tube, which is arranged between the filter and the second solenoid valve.

2. The air conditioning system as claimed in claim 1, wherein the first heat exchanger is also provided with a gas collection tube, and the throttle mechanism is connected to the top of the gas collection tube.

3. The air conditioning system as claimed in claim 1, further comprising: a gas-liquid separator; the gas-liquid separator is arranged between the four-way valve and the compressor.

4. The air conditioning system as claimed in claim 1, further comprising:

a controller, which is connected to at least one control mechanism and is configured to send a control instruction to the at least one control mechanism in the air conditioning system according to at least one load parameter of the air conditioning system; wherein the control instruction is used for instructing the at least one control mechanism to control the corresponding heat exchanger to be in the first working state or the second working state.

5. The air conditioning system as claimed in claim 1, wherein the at least one heat exchanger is an outdoor heat exchanger group; the air conditioning system further comprises an indoor heat exchanger group, which is connected to the outdoor heat exchanger group; wherein each heat exchanger is provided with an expansion valve; the expansion valve is configured to control the disconnection of a flow path between the corresponding one of the at least one heat exchanger and the indoor heat exchanger group when the amount of refrigerant stored by the corresponding heat exchanger exceeds a preset threshold.

6. A control method of an air conditioning system, comprising:

determining at least one load parameter of the air conditioning system, wherein the conditioning system is an air conditioning system as claimed in claim 1; and sending a control instruction to the at least one control mechanism in the air conditioning system according to the at least one load parameter of the air conditioning system; wherein the control instruction is used for instructing the control mechanism to control the at least one heat exchanger to switch between the first working state and the second working state; wherein the heat exchanger drains liquid when in the first working state and stores liquid when in the second working state.

7. The method as claimed in claim 6, wherein the at least one heat exchanger in the air conditioning system comprises an indoor heat exchanger group and an outdoor heat exchanger group; the outdoor heat exchanger group comprises a first heat exchanger of the at least one heat exchanger; an expansion valve is arranged between the first heat exchanger and the indoor heat exchanger group; sending the control instruction to the control mechanism in the air conditioning system according to at least one load parameter of the air conditioning system comprises:

judging whether the amount of refrigerant in the first heat exchanger exceeds a preset threshold;

if the result is judged as yes, controlling the expansion valve to close.

8. The method as claimed in claim 6, wherein at least one load parameter comprises at least one of the following parameters:

an ambient temperature of an outdoor unit of the air conditioning system;

a high pressure parameter of the air conditioning system;

a low pressure parameter of the air conditioning system;

a discharge superheat degree of the air conditioning system; and a supercooling degree of an indoor unit of the air conditioning system.

* * * * *